United States Patent [19]

Grenda

[11] 4,252,618

[45] Feb. 24, 1981

[54] METHOD OF ELECTROPLATING TIN AND ALKALINE ELECTROPLATING BATH THEREFOR

[75] Inventor: David W. Grenda, Houston, Pa.

[73] Assignee: Pitt Metals & Chemicals, Inc., Pittsburgh, Pa.

[21] Appl. No.: 120,714

[22] Filed: Feb. 11, 1980

[51] Int. Cl.[3] ..... C25D 3/60

[52] U.S. Cl. ..... 204/43 S

[58] Field of Search ..... 204/43 S; 106/1.22

[56] References Cited

U.S. PATENT DOCUMENTS

| | | | |
|---|---|---|---|
| 3,360,446 | 12/1967 | Jongkind | 204/43 S |
| 3,522,155 | 7/1970 | Dow | 204/43 S |
| 4,162,205 | 7/1979 | Wilson et al. | 204/43 S |

FOREIGN PATENT DOCUMENTS

| | | | |
|---|---|---|---|
| 349761 | 9/1972 | U.S.S.R. | 204/43 S |

*Primary Examiner*—G. L. Kaplan

*Attorney, Agent, or Firm*—Stanley J. Price, Jr.; John M. Adams

[57] ABSTRACT

An improved electroplating process and electroplating bath therefor is disclosed which is adapted to electrodeposit a tin-bismuth alloy. The electroplating bath contains tin ions, an alkali metal hydroxide, and bismuth citrate. Bismuth citrate exhibits relatively high solubility in hot alkaline alkali metal stannate electroplating baths when compared to conventional alkali metal bismuthates or other bismuth compounds which in general have poor solubility in hot alkali metal stannate electroplating baths. An improved process is provided for electrodepositing a tin-bismuth alloy on panels as adherent and uniform plates without signs of staining or tin-bismuth nodules. An additional and important feature of this invention is the advantageous blending of the bismuth citrate with the alkalic metal stannate in the dry solid state, if and when desired.

3 Claims, No Drawings

METHOD OF ELECTROPLATING TIN AND ALKALINE ELECTROPLATING BATH THEREFOR

This invention relates to an improvement in the method of producing electrodeposits of tin, and is particularly concerned with plating baths which employ a small amount of bismuth in tin electroplates to inhibit the well-known tin "disease" or "tin pest", that is, the formation of a loose tin powder which easily separates from the base metal, exposing it to the effects of corrosion. Many bismuth compounds have been proposed as additives to electroplating baths to inhibit the formation of tin pest. These suffer from one or more of the following disadvantages—too low a solubility in the electroplating bath, instability under electroplating conditions (e.g. hydrolysis), expense, staining, formation of tin-bismuth nodules, poorly adherent or non uniform plates, and inability to blend with the alkali metal stannate in the dry solid state in the desired proportions prior to making the electroplating solution.

In accordance with my invention I have provided a bismuth additive for alkaline tin plating baths. That additive is bismuth citrate—

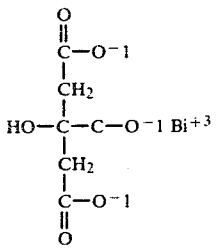

An improved process for electrodepositing a tin containing alloy is thereby provided. The bismuth citrate is adequately soluble in alkaline alkali metal stannate solutions, and stable in such solutions when hot. The bismuth ions are effectively released to form with the tin an adherent and uniform plate. An especially desirable advantage of bismuth citrate is the opportunity it affords to blend with the alkali metal stannate in the dry solid state in intimate desired proportions prior to addition to the electroplating solution.

Bismuth citrate may be purchased, or it may be made by any one of several methods. A convenient and suitable method is to make it from either $Bi^{+}$ or $Bi^{+\equiv}$ compounds as for example an alkali metal bismuthate and citric acid. Using sodium bismuthate for purposes of illustration, the sodium bismuthate is added to a stirred solution of citric acid at 120° F. The mole ratio of reactants is 1:10 respectively. As the reaction proceeds, carbon dioxide is liberated. The reaction is exothermic. A compound is formed which is white in color and only sparingly soluble in the reaction medium. The mole ratio of 1:10 assures that all the bismuthate is consumed in the reaction. Complete consumption of the bismuthate is observed by the disappearance of the canary yellow bismuthate color. The precipitate, bismuth citrate, is filtered, washed and dried at 105° C.

DETAILED DESCRIPTION OF THE INVENTION

The preferred embodiment of this invention is illustrated by the following examples and tests which, however, are to be considered as illustrative only of the present invention. It should be understood that the invention is not limited to the specific details therein set forth:

I. Effect of Bismuth Concentration

A stock plating solution was prepared for all of the plating tests described below. This solution contained 150 gm/l. tin as metal from potassium stannate and 22.5 gm/l. potassium hydroxide.

The bath was maintained at 88° C. and Steel Hull cell panels were plated after the addition of 10, 20, 40, 60, 80 and 110 ppm bismuth added in the form of bismuth citrate. The current density of each test was 6.45 amperes per square decimeter. The following table I shows the percentage of bismuth contained in the plate after 30 minutes deposition.

| % Bismuth in Alloy | ppm Bismuth in Bath |
|---|---|
| .08 | 10 |
| .31 | 20 |
| .39 | 30 |
| .60 | 40 |
| .68 | 50 |
| .75 | 60 |
| .93 | 70 |
| 1.10 | 80 |

The plates were adherent and uniform without signs of staining or tin-bismuth nodules.

II. Successive Plating

A plating bath was made up to contain 22.5 gm/l. KOH, 150 gm/l. tin from potassium stannate and 22.5 ppm bismuth in the bath from bismuth citrate. A Steel-Hull cell panel was electroplated at 6.45 amperes per square decimeter for 30 minutes. 1.577 grams of tin-bismuth alloy were deposited with 0.31% bismuth in the plate. Bath analysis at this point was 109.8 gm/l. tin, and 18.5 ppm bismuth. This corresponds to a 27% reduction in tin and 18% reduction in bismuth.

A second panel was plated under the same conditions with the used bath. 1.528 gms of tin-bismuth alloy were plated with 0.15% bismuth in the alloy. The bath composition at this point was 73.3 gm/l. tin, 11.6 ppm. bismuth, and 0.15% bismuth in the plate. This represents a reduction of 51% tin and 51% bismuth from the initial concentrations.

A third panel was plated under the same conditions with the used bath from the electroplating of the second panel. The resulting concentrations of the bath were 73.3 gm/l. tin, 11.6 ppm bismuth, and 0.13% in the plate.

The foregoing successive plating tests demonstrate that the bismuth plates uniformly and not preferentially to the tin.

III. Dry Blending

It is an added feature of this compound to allow blending in the dry form with the alkali metal stannate. A mixture of potassium stannate and bismuth citrate was prepared with the bismuth citrate present at 0.04% by weight. A bath was made up with this blend. After plating 0.23% bismuth was found in the plate.

IV. Hull Cell Tests

To confirm the ability of bismuth citrate to act as a satisfactory method of bismuth addition to an alkaline tin plating bath, a standard Hull cell panel was run on the prepared bath. The conditions were 22.5 gm/l. KOH, 150 gm/l. tin, 20 ppm bismuth from bismuth citrate, and 88° C. The standard panel was run at 3 amperes for 15 minutes. Good plating was observed over the whole range of 15–120 amperes per square foot.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. In a method for electroplating a tin-containing alloy onto a conductive substrate comprising immersing the conductive substrate to be plated in an aqueous alkaline plating bath containing alkali metal stannate, alkali metal hydroxide, and a bismuth compound, and electroplating a tin-containing alloy onto the substrate, the improvement comprising using as the bismuth compound bismuth citrate.

2. The method of claim 1 wherein the bismuth citrate and the alkali metal stannate are blended in the dry solid state before addition to the plating bath.

3. An aqueous alkaline solution for plating a tin-containing alloy on a conductive substrate which solution comprises an alkali metal stannate and bismuth citrate.

* * * * *